US009325066B2

(12) United States Patent
Wong et al.

(10) Patent No.: US 9,325,066 B2
(45) Date of Patent: Apr. 26, 2016

(54) COMMUNICATION DEVICE AND METHOD FOR DESIGNING ANTENNA ELEMENT THEREOF

(71) Applicants: INDUSTRIAL TECHNOLOGY RESEARCH INSTITUTE, Hsinchu (TW); NATIONAL SUN YAT-SEN UNIVERSITY, Kaohsiung (TW)

(72) Inventors: Kin-Lu Wong, Kaohsiung (TW); Hsuan-Jui Chang, Taichung (TW); Wei-Yu Li, Yilan (TW); Chun-Yih Wu, Taipei (TW)

(73) Assignees: INDUSTRIAL TECHNOLOGY RESEARCH INSTITUTE, Hsinchu (TW); NATIONAL SUN YAT-SEN UNIVERSITY, Kaohsiung (TW)

( * ) Notice: Subject to any disclaimer, the term of this patent is extended or adjusted under 35 U.S.C. 154(b) by 280 days.

(21) Appl. No.: 13/906,483

(22) Filed: May 31, 2013

(65) Prior Publication Data

US 2014/0085159 A1 Mar. 27, 2014

(30) Foreign Application Priority Data

Sep. 27, 2012 (TW) ..... 101135565 A

(51) Int. Cl.
*H01Q 5/00* (2015.01)
*H01Q 1/24* (2006.01)
(Continued)

(52) U.S. Cl.
CPC ..... *H01Q 5/0027* (2013.01); *H01Q 1/243* (2013.01); *H01Q 5/328* (2015.01); *H01Q 5/378* (2015.01); *H01Q 9/42* (2013.01); *Y10T 29/49016* (2015.01)

(58) Field of Classification Search
CPC .... H01Q 5/0027; H01Q 5/378; H01Q 1/3781
USPC ..... 343/700, 843; 235/492
See application file for complete search history.

(56) References Cited

U.S. PATENT DOCUMENTS 5,434,579 A 7/1995 Kagoshima et al.
5,574,410 A * 11/1996 Collins et al. ..... 333/17.3
(Continued)

FOREIGN PATENT DOCUMENTS

CN 101953022 A 1/2011
CN 102195122 A 9/2011
(Continued)

OTHER PUBLICATIONS

U.S. Appl. No. 13/528,853.
(Continued)

*Primary Examiner* — Michael C Wimer
*Assistant Examiner* — Bamidele A Jegede
(74) *Attorney, Agent, or Firm* — McClure, Qualey & Rodack, LLP

(57) ABSTRACT

A communication device including a ground plane and an antenna element is provided. An edge of the ground plane is embedded with a notch, which has at least a first edge and a second edge. The antenna element, disposed at the notch, has at least a first operating frequency band and a second operating frequency band. The antenna element includes a first conductive portion and a second conductive portion. The first conductive portion has a starting terminal, electrically coupled to the first edge of the notch through a signal source, as a feeding terminal of the antenna element. A capacitive coupling portion is formed between an end terminal of the first conductive portion and the ground plane. The second conductive portion has a shorting terminal electrically coupled or connected to the second edge of the notch.

14 Claims, 7 Drawing Sheets

(51) Int. Cl.

| | |
|---|---|
| ***H01Q 9/42*** | (2006.01) |
| ***H01Q 5/328*** | (2015.01) |
| ***H01Q 5/378*** | (2015.01) |

(56) References Cited

U.S. PATENT DOCUMENTS

| | | | | |
|---|---|---|---|---|
| 5,835,063 | A | 11/1998 | Brachat et al. | |
| 6,459,413 | B1 | 10/2002 | Tseng et al. | |
| 6,573,869 | B2 | 6/2003 | Moore | |
| 6,614,400 | B2 | 9/2003 | Egorov | |
| 6,650,294 | B2 | 11/2003 | Ying et al. | |
| 6,664,931 | B1 | 12/2003 | Nguyen et al. | |
| 6,680,705 | B2 | 1/2004 | Tan et al. | |
| 6,774,850 | B2 | 8/2004 | Chen | |
| 6,788,257 | B2 | 9/2004 | Fang et al. | |
| 6,801,168 | B1 | 10/2004 | Yeh | |
| 6,917,339 | B2 | 7/2005 | Li et al. | |
| 6,965,348 | B2 * | 11/2005 | Caimi et al. | 343/722 |
| 6,977,616 | B2 | 12/2005 | Yuanzhu | |
| 6,985,108 | B2 | 1/2006 | Mikkola et al. | |
| 7,026,999 | B2 | 4/2006 | Umehara et al. | |
| 7,113,143 | B2 * | 9/2006 | Minemura | 343/870 |
| 7,215,289 | B2 | 5/2007 | Harano | |
| 7,242,364 | B2 | 7/2007 | Ranta | |
| 7,256,743 | B2 | 8/2007 | Korva | |
| 7,268,730 | B2 | 9/2007 | Park et al. | |
| 7,315,289 | B2 | 1/2008 | Puente Baliarda et al. | |
| 7,339,531 | B2 | 3/2008 | Desclos et al. | |
| 7,425,924 | B2 | 9/2008 | Chung et al. | |
| 7,482,984 | B2 | 1/2009 | Rosengren et al. | |
| 7,535,431 | B2 | 5/2009 | Rowell | |
| 7,564,413 | B2 | 7/2009 | Kim et al. | |
| 7,589,673 | B2 * | 9/2009 | Kuramoto | 343/700 MS |
| 7,639,194 | B2 | 12/2009 | Chi et al. | |
| 7,825,863 | B2 * | 11/2010 | Martiskainen et al. | 343/702 |
| 8,054,229 | B2 | 11/2011 | Kaneoya | |
| 8,508,421 | B2 * | 8/2013 | Mishan et al. | 343/771 |
| 8,684,272 | B2 * | 4/2014 | Wong et al. | 235/492 |
| 8,933,852 | B2 * | 1/2015 | Wong et al. | 343/728 |
| 2006/0227052 | A1 | 10/2006 | Tavassoli Hozouri | |
| 2007/0146212 | A1 | 6/2007 | Ozden et al. | |
| 2007/0257842 | A1 | 11/2007 | Tseng | |
| 2009/0153423 | A1 | 6/2009 | Dinallo et al. | |
| 2009/0189815 | A1 | 7/2009 | Hotta et al. | |
| 2009/0256763 | A1 | 10/2009 | Chi et al. | |
| 2009/0273521 | A1 | 11/2009 | Wong et al. | |
| 2009/0273530 | A1 | 11/2009 | Chi et al. | |
| 2011/0095947 | A1 | 4/2011 | Chou | |
| 2011/0122027 | A1 | 5/2011 | Wong et al. | |
| 2012/0001815 | A1 | 1/2012 | Wong et al. | |
| 2012/0105292 | A1 | 5/2012 | Wong et al. | |
| 2013/0002501 | A1 | 1/2013 | Li et al. | |
| 2013/0038491 | A1 | 2/2013 | Li et al. | |

FOREIGN PATENT DOCUMENTS

| | | | |
|---|---|---|---|
| CN | 102208713 | A | 10/2011 |
| CN | 102324621 | A | 1/2012 |
| CN | 102683830 | A | 9/2012 |
| TW | 1291783 | | 12/2007 |
| TW | I291783 | | 12/2007 |
| TW | 1307565 | | 3/2009 |
| TW | M397043 | | 1/2011 |
| TW | M397043 | U1 | 1/2011 |

OTHER PUBLICATIONS

English Abstract translation of TW1291783 (Published Dec. 21, 2007).

English Abstract translation of TWI307565 (Published Mar. 11, 2009).

English Abstract translation of TWM397043 (Published Jan. 21, 2011).

English Abstract translation of CN102324621 (Published Jan. 18, 2012).

Villanen, et al.: "A Coupling Element-Based Quadband Antenna Structure for Mobile Terminals"; Microwave and Optical Technology Letters / vol. 49, No. 6, Jun. 2007; pp. 1277-1282.

Stutzman, et al.: "Antenna Theory and Design";Published Dec. 29, 1997; pp. 57-87.

Kang, et al.: "Chip-Inductor-Embedded Smallsize Printed Strip Monopole for WWAN Operation in the Mobile Phone"; Microwave and Optical Technology Letters / vol. 51, No. 4, Apr. 2009; pp. 966-971.

Yeh, et al.: "Compact Dual-Frequency PIFA With a Chip-Inductor-Loaded Rectangular Spiral Strip"; Microwave and Optical Technology Letters / vol. 33, No. 6, Jun. 20, 2002; pp. 394-397.

Wong, et al.: "Compact Multiband PIFA With a Coupling Feed for Internal Mobile Phone Antenna"; Microwave and Optical Technology Letters / vol. 50, No. 10, Oct. 2008; pp. 2487-2491.

Hsien, et al.: "EMC Internal GSM/DCS Patch Antenna for Thin PDA Phone Application"; Microwave and Optical Technology Letters / vol. 49, No. 2, Feb. 2007; pp. 403-408.

Chang, et al.: "GSM850/900/1800/1900/UMTS Coupled-FED Planar /8-PIFA for Internal Mobile Phone Antenna"; Microwave and Optical Technology Letters / vol. 51, No. 4, Apr. 2009; pp. 1091-1096.

Chi, et al.: "Half-Wavelength Loop Strip Capacitively Fed by a Printed Monopole for Penta-and Mobile Phone Antenna"; Microwave and Optical Technology Letters / vol. 50, No. 10, Oct. 2008; pp. 2549-2554.

Chi, et al.: "Internal Compact Dual-Band Printed Loop Antenna for Mobile Phone Application"; IEEE Transactions on Antennas and Propagation, vol. 55, No. 5, May 2007; pp. 1457-1462.

Wu, et al.: "On the Impedance Bandwidth of a Planar Inverted-F Antenna for Mobile Handsets"; Microwave and Optical Technology Letters / vol. 32, No. 4, Feb. 20, 2002; pp. 249-251.

Kin-Lu Wong: "Planar Antennas for Wireless Communications"; Copyright 2003 by John Wiley & Sons, Inc.; pp. 1-127.

Chang, et al.: "Printed 8-PIFA for Penta-Band WWAN Operation in the Mobile Phone"; IEEE Transactions on Antennas and Propagation, vol. 57, No. 5, May 2009; pp. 1373-1381.

Wong, et al.: "Printed Loop Antenna With a Perpendicular Feed for Penta-Band Mobile Phone Application"; IEEE Transactions on Antennas and Propagation, Vol. 56, No. 7, Jul. 2008; pp. 2138-2141.

Wong, et al.: "Printed PIFA With a Coplanar Coupling Feed for Penta-Band Operation in the Mobile Phone"; Microwave and Optical Technology Letters / vol. 50, No. 12, Dec. 2008; pp. 3181-3186.

Wong, et al.: "Printed Single-Strip Monopole Using a Chip Inductor for Penta-Band WWAN Operation in the Mobile Phone"; IEEE Transactions on Antennas and Propagation, vol. 58, No. 3, March 2010; pp. 1011-1014.

Chi, et al.: "Quarter-Wavelength Printed Loop Antenna With an Internal Printed Matching Circuit for GSM/DCS/PCS/MTS Operation in the Mobile Phone"; IEEE Transactions on Antennas and Propagation, vol. 57, No. 9, Sep. 2009; pp. 2541-2547.

Wu, et al.: "Simplified Hand Model Including the User'S Forearm for the Study of Internal GSM/DCS Mobile Phone Antenna"; Microwave and Optical Technology Letters / vol. 48, No. 11, Nov. 2006; pp. 2202-2205.

Chi, et al.: "Very-Small-Size Printed Loop Antenna for GSM/DCS/PCS/UMTS Operation in the Mobile Phone"; Microwave and Optical Technology Letters / vol. 51, No. 1, Jan. 2009; pp. 184-192.

Li, et al.: "Six-Band Internal Antenna for Small-Size Mobile Phone"; Microwave and Optical Technology Letters / vol. 50, No. 9, Sep. 2008; pp. 2242-2247.

TW Office Action dated Mar. 13, 2015 in corresponding application (No. 101135565).

CN Office Action dated May 26, 2015 in corresponding application (No. 201210433712.3).

SIPO Office Action dated Nov. 23, 2015 in corresponding CN application (No. 201210433712.3).

Wong, et al.; "On-Board Printed Coupled-Fed Loop Antenna in Close Proximity to the Surrounding Ground Plane for Penta-Band WWAN Mobile Phone"; IEEE Transactions on Antennas and Propagation, vol. 59, No. 3, Mar. 2011; pp. 751-757.

* cited by examiner

COMMUNICATION DEVICE AND METHOD FOR DESIGNING ANTENNA ELEMENT THEREOF

This application claims the benefit of Taiwan application Serial No. 101135565, filed Sep. 27, 2012, the disclosure of which is incorporated by reference herein in its entirety.

TECHNICAL FIELD

The disclosed embodiments relate to a communication device and a method for designing an antenna element thereof.

BACKGROUND

In contribution to advancements in integrated circuits and system-on-package (SOP) techniques, the required area of a system ground plane of an internal communication circuit module in a cell phone is remarkably reduced. Thus, communication modules for different system band operation could be integrated into one single mobile communication device. However, other issues such as limited antenna space within a cell phone and electromagnetic compatibility problems between antenna elements or system modules of different applications may arise. System ground planes of different mobile communication devices usually come in shapes with different defects, which are disadvantages for exciting lower band resonant modes of WWAN (Wireless Wide Area Network) antennas in the mobile communication devices. This is because a complete ground plane could effectively decrease overall quality factors of antennas and make the antennas to generate wider operating bandwidths at lower frequency bands. As a result, there is a challenge for the design of multi-band WWAN antennas due to the effect that an incomplete ground plane imposes on the excitation of resonant modes at lower frequency bands. Further, since impedance bandwidths of resonant modes of an antenna would be easily affected by size variations of the ground plane connected, a time-consuming process for adjusting dimensions of the antenna is frequently needed for adapting to different sizes of ground planes of mobile communication devices.

SUMMARY

The disclosure is directed to a communication device and a method for designing an antenna thereof.

According to one embodiment, a communication device comprising at least a ground plane and an antenna element is provided. An edge of the ground plane is embedded with a notch having at least a first edge and a second edge. The antenna element, disposed at the notch, has at least a first operating frequency band and a second operating frequency band. The first operating frequency band is lower than the second operating frequency band. The antenna element comprises a first conductive portion and a second conductive portion. The first conductive portion has a starting terminal as a feeding terminal of the antenna element, wherein the feeding terminal is electrically coupled to the first edge of the notch via a signal source. A capacitive coupling portion is formed between an end terminal of the first conductive portion and the ground plane. The second conductive portion has a shorting terminal electrically coupled or connected to the second edge of the notch.

According to another embodiment, a method for designing an antenna element for a communication device is provided. The method includes the following steps. A notch is embedded at an edge of a ground plane of the communication device. The notch of the ground plane has at least a first edge and a second edge. A first conductive portion electrically coupled to the first edge of the notch via a signal source is disposed. The first conductive portion has a starting terminal as a feeding terminal of the antenna element, wherein the feeding terminal is electrically coupled to the first edge of the notch via a signal source. A capacitive coupling portion is formed between an end terminal of the first conductive portion and the ground plane. A second conductor portion having a shorting terminal electrically coupled or connected to the second edge of the notch is disposed, such that the antenna element generates at least a first operating frequency band and a second operating frequency band higher than the first operating frequency band.

Figure 1A:
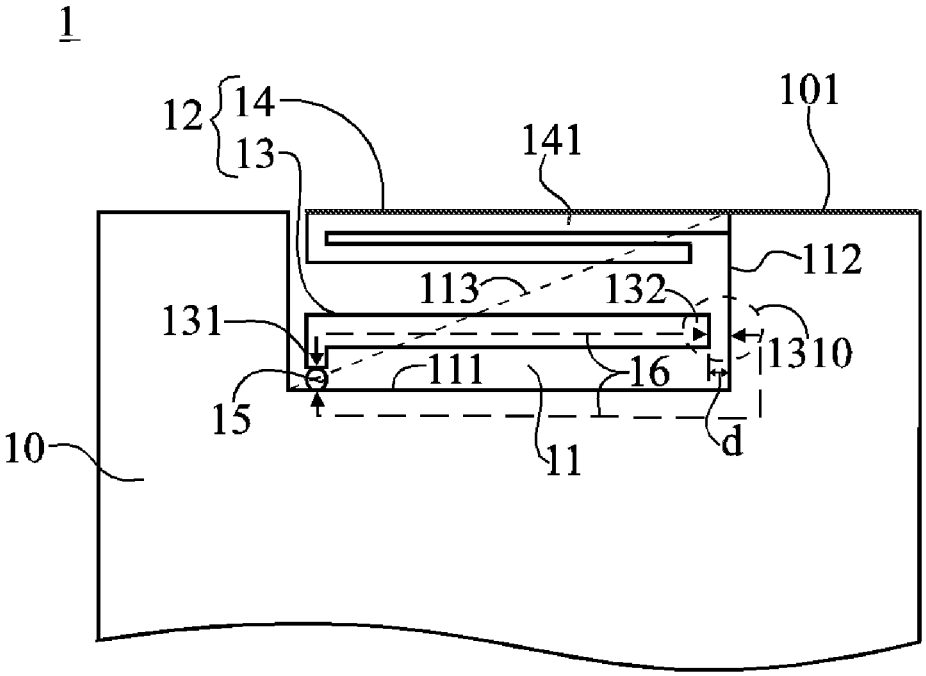
FIG. 1A is a schematic diagram of a communication device 1 according to one embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

A communication device and a method for designing an antenna element thereof are disclosed by embodiments below. In the communication device, an antenna element could utilize edges of a neighboring system ground plane to form a part of current resonant paths of the antenna element, so as to reduce an overall size of the antenna element as well as excite multi-band resonant modes in adaptation to different sizes of ground planes.

FIG. 1A shows a schematic diagram of a communication device 1 according to one embodiment. As shown in FIG. 1A, the communication device 1 comprises a ground plane 10 and an antenna element 12.

An edge 101 (an upper edge in FIG. 1A) of the ground plane 10 is embedded with a notch 11. The notch 11 of the ground plane 10 has at least a first edge 111 and a second edge 112. For example, as shown in FIG. 1A, the first edge 111 is a horizontal edge and the second edge 112 is a vertical edge.

The antenna element 12 is disposed at the notch 11. Also referring to FIG. 1B, the antenna element 12 has at least a first operating frequency band 21 and a second operating frequency band 22 higher than the first operating frequency band 21.

The antenna element 12 includes a first conductive portion 13 and a second conductive portion 14. The first conductive portion 13 has a starting terminal 131 as a feeding terminal of the antenna element 12. The feeding terminal is electrically coupled to the first edge 111 of the notch 11 via a signal source 15. The first conductive portion 13 substantially extends along the first edge 111, and further has an end terminal 132. A capacitive coupling portion 1310 is formed between the end terminal 132 of the first conductive portion 13 and the ground plane 10. The second conductive portion 14 has a shorting terminal 141 electrically coupled or connected to the second edge 112 of the notch 11. A matching circuit (not shown) may also be provided between the feeding terminal of the antenna element 12 and the signal source 15 to adjust an impedance bandwidth of the operating frequency bands of the antenna element 12. The matching circuit may comprise a capacitive, inductive, or resistive element or a signal transmission line. A matching circuit may also be provided between the shorting terminal 141 of the second conductive portion 14 and the ground plane 10 to further adjust the impedance bandwidth of the operating frequency bands of the antenna element 12. The matching circuit may comprise a capacitive, inductive, or resistive element or a signal transmission line.

Figure 1B:
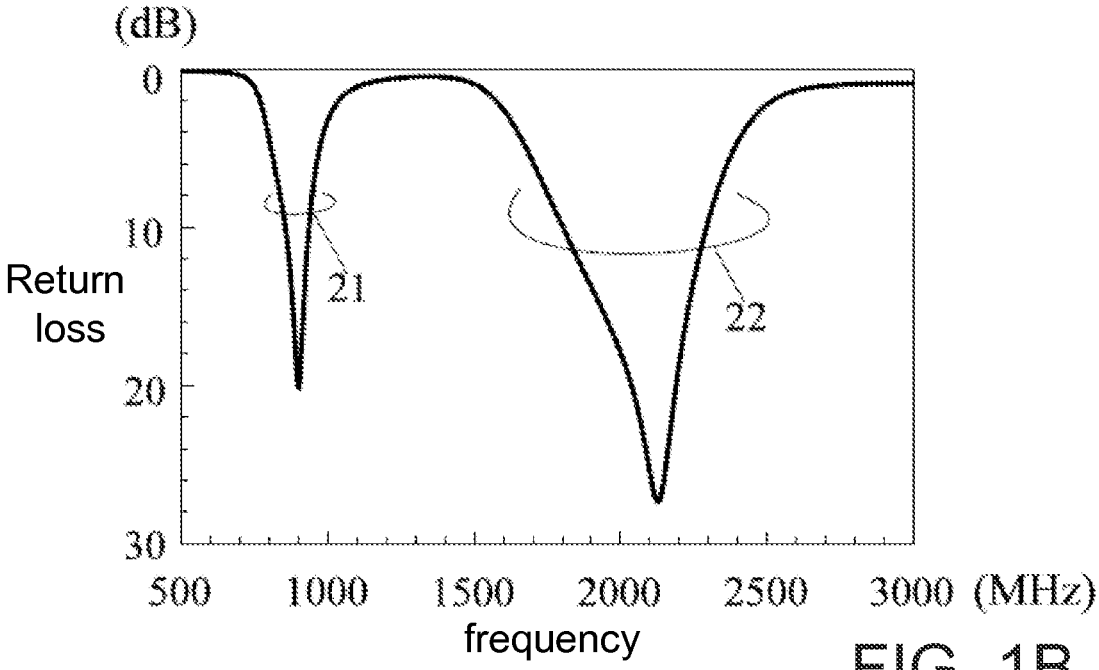
FIG. 1B is a diagram showing return loss of an antenna element of the communication device 1 according to one embodiment.

In the communication device 1 in FIG. 1A, the notch 11 may substantially be a rectangle. The first edge 111 is connected with the second edge 112, and has a length greater than a length of the second edge 112. The shorting terminal 141 of the second conductive portion 14 and the feeding terminal 131 of the antenna element 12 are respectively located near two end points of a diagonal line 113 of the notch 11. The capacitive coupling portion 1310 has a coupling distance d. By adjusting the coupling distance d, an equivalent loop resonant structure 16 is formed through the first conductive portion 13 and the first edge 111 of the ground plane 10. The equivalent loop resonant structure 16, forming an excitation source of the second conductive portion 14, excites resonance of the second conductive portion 14 to generate the first operating frequency band 21 and the second operating frequency band 22 (as shown in FIG. 1B) of the antenna element 12. The second operating frequency band 22 is a higher mode of the first operating frequency band 21. The first operating frequency band 21 and the second operating frequency band 22 respectively cover at least one communication system band, and are for transceiving electromagnetic signals. The coupling distance d is less than or equal to two percent of the wavelength of the lowest operating frequency of the lowest communication system band covered by the first operating frequency band. The capacitive coupling portion 1310 may also be designed with a capacitive element. By adjusting a capacitance value of the capacitive element, the equivalent loop resonant structure 16 may also be formed through the first conductive portion 13 and the first edge 111 of the ground plane 10.

In the communication device 1 in FIG. 1A, the equivalent loop resonant structure 16 formed by the first conductive portion 13 and the first edge 111 makes stronger and more uniform surface current to be excited at the area of the ground plane 10 around the antenna element 12. Thus, the variation degree of input impedance at the feeding terminal (i.e. the starting terminal 131) of the antenna element 12 could be mitigated to increase the operating bandwidth of the resonant modes of the antenna element 12. Further, when the antenna element 12 resonates, the equivalent loop resonant structure 16 could make more strong surface currents excited by the antenna element 12 to be concentrated at the area of the ground plane 10 around the antenna element 12. Consequently, undesirable effects caused by different shapes of the ground plane 10 on the resonant modes excited by the antenna element 12 could be mitigated. In this embodiment, by respectively disposing the shorting terminal 141 of the second conductive portion 14 and the feeding terminal 131 of the antenna element 12 near the two end points of the diagonal line 113 of the notch 11, the excitation source formed by the equivalent loop resonant structure 16 is allowed to utilize the first edge 111 and the second edge 112 as a part of current resonant paths of the antenna element 12. Hence, the required resonant length of the second conductive portion 14 could be decreased to reduce an overall size of the antenna element 12. The length of the second conductive portion 14 is smaller than one-fifth wavelength of the lowest operating frequency in the lowest communication system band covered by the first operating frequency band 21.

By designing the equivalent loop resonant structure 16 to excite the second conductive portion 14 for generating lower and higher resonant modes, not only multi-band operations for the antenna element 12 could be achieved, but also the overall size of the antenna element 12 is reduced, compared to conventional dual-path antenna designs of mobile phones.

Furthermore, by designing the second conductive portion 14 to be electrically coupled to the second edge 112, the distance between the second conductive portion 14 and the first edge 111 is also increased for reducing mutual coupling between the second conductive portion 14 and the ground plane 10. It could enhance radiation efficiencies of the first operating frequency band 21 and the second operating frequency band 22 generated by the resonance of the second conductive portion 14. The first conductive portion 13 or the second conductive portion 14 may also be designed with an inductive element or a meandering section, or any combination thereof, for reducing the size of the antenna element 12.

In the communication device 1 in FIG. 1A, the notch 11 is substantially a rectangle, the first conductive portion 13 is substantially an inverted L-shaped structure, and the second conductive portion 14 has a bent section to substantially appear as an inverted horseshoe-shaped structure. It should be noted that, details of FIG. 1A are illustrated as a design example of the communication device 1 and are not to be construed as limitations to the embodiments. The first conductive portion 13 and the second conductive portion 14 may be structures in other forms having different bending designs, or may be non-planar stereoscopic structures. The notch 11 may also be a non-rectangle or a shape having irregular edges, and may also achieve the same effects as the communication device 1 in FIG. 1A.

FIG. 1B is a diagram showing return loss of the antenna element 12 of the communication device 1 according to one embodiment. The return loss diagram is based on an experiment of the selected measurements and conditions below. The ground plane 10 has a length of approximately 110 mm and a width of approximately 60 mm. The first conductive portion 13 has a length of approximately 30 mm. The second conductive portion 14 has a length of approximately 64 mm, and has one bent section to form an inverted horseshoe-shaped structure. The first edge 111 of the notch 11 embedded in the ground plane 10 is approximately 32 mm, and the second edge 112 of the notch 11 is approximately 10 mm. The shorting terminal 141 of the second conductive portion 14 and the feeding terminal 131 of the antenna element 12 are located near the two end points of the diagonal line 113 of the notch 11. By designing the capacitive coupling portion 1310, the equivalent loop resonant structure 16 is formed by the first conductive portion 13 and the first edge 111. The equivalent loop resonant structure 16 forms the excitation source of the second conductive portion 14, such that the second conductive portion 14 is excited to form the resonance for generating the at least one first operating frequency band 21 and the second operating frequency band 22. The second operating frequency band 22 is formed by a higher resonant mode of the first operating frequency band 21. The coupling distance d of the capacitive coupling portion 1310 is less than or equal to two percent of the wavelength of the lowest operating frequency of the lowest communication system band covered by the first operating frequency band 21. The shorting terminal 141 of the second conductive portion 14 and the feeding terminal 131 of the antenna element 12 are respectively located near the two end points of the diagonal line 113 of the notch 11. The excitation source formed by the equivalent loop resonant structure 16 uses the first edge 111 and the second edge 112 as a part of current resonant paths of the antenna element 12. Hence, the physical resonant length required for the second conductive portion 14 could be decreased to reduce the overall size of the antenna element 12. The length of the second conductive portion 14 is smaller than one-fifth wavelength of the lowest operating frequency of the lowest communication system band covered by the first operating frequency band 21.

In FIG. 1B depicting the communication device 1 according to one embodiment, the first operating frequency band 21 and the second operating frequency band 22 generated by the antenna element 12 may respectively cover GSM850/900 (824 to 960 MHz) and GSM1800/1900/UMTS (1710 to 2170 MHz) communication system bands, and are for transceiving electromagnetic signals covered by the above system bands. In FIG. 1A, the first operating frequency band 21 and the second operating frequency band 22 generated by the communication device 1 are illustrated as an example for transceiving electromagnetic signals of at least one communication system band, and are not to be construed as a limitation to the embodiments. The operating frequency band generated by the antenna element 12 may also transceive electromagnetic signals of Global System for Mobile Communications (GSM), Universal Mobile Telecommunications System (UMTS), Worldwide Interoperability Microwave Access (WiMAX), Digital Television Broadcasting (DVB), Global Positioning System (GPS), WWAN, Wireless Wide Area Network (WLAN), Ultra-Wideband (UWB), Wireless Personal Area Network (WPAN), or Satellite Communication System standards, or other wireless or mobile communication system bands.

Figure 1C:
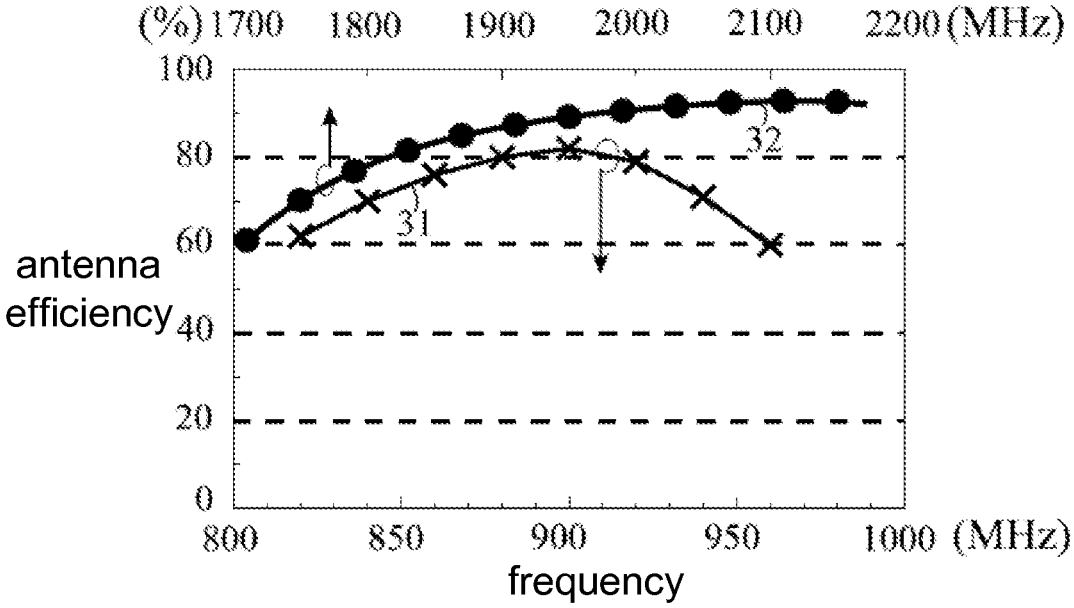
FIG. 1C is a diagram of an antenna efficiency curve of the communication device 1 according to one embodiment.

FIG. 1C shows a diagram of an antenna efficiency curve of the communication device 1 according to one embodiment. An antenna efficiency curve 31 is based on efficiency data of the antenna element 12 in the GSM850/900 communication system bands, and an antenna efficiency curve 32 is based on efficiency data of the antenna element 12 in the GSM1800/1900/UMTS communication system bands. As observed from FIG. 1C, the antenna element 12 provides about 60% to 82% antenna radiation efficiency in the GSM850/900 bands, and provides about 60% to 92% antenna radiation efficiency in the GSM1800/1900/UMTS bands, thereby fulfilling practical application requirements. The above example is for explaining experimental results of the communication device 1 under selected measurements and conditions according to one embodiment, and is not to be construed as a limitation to the embodiments.

Figure 2A:
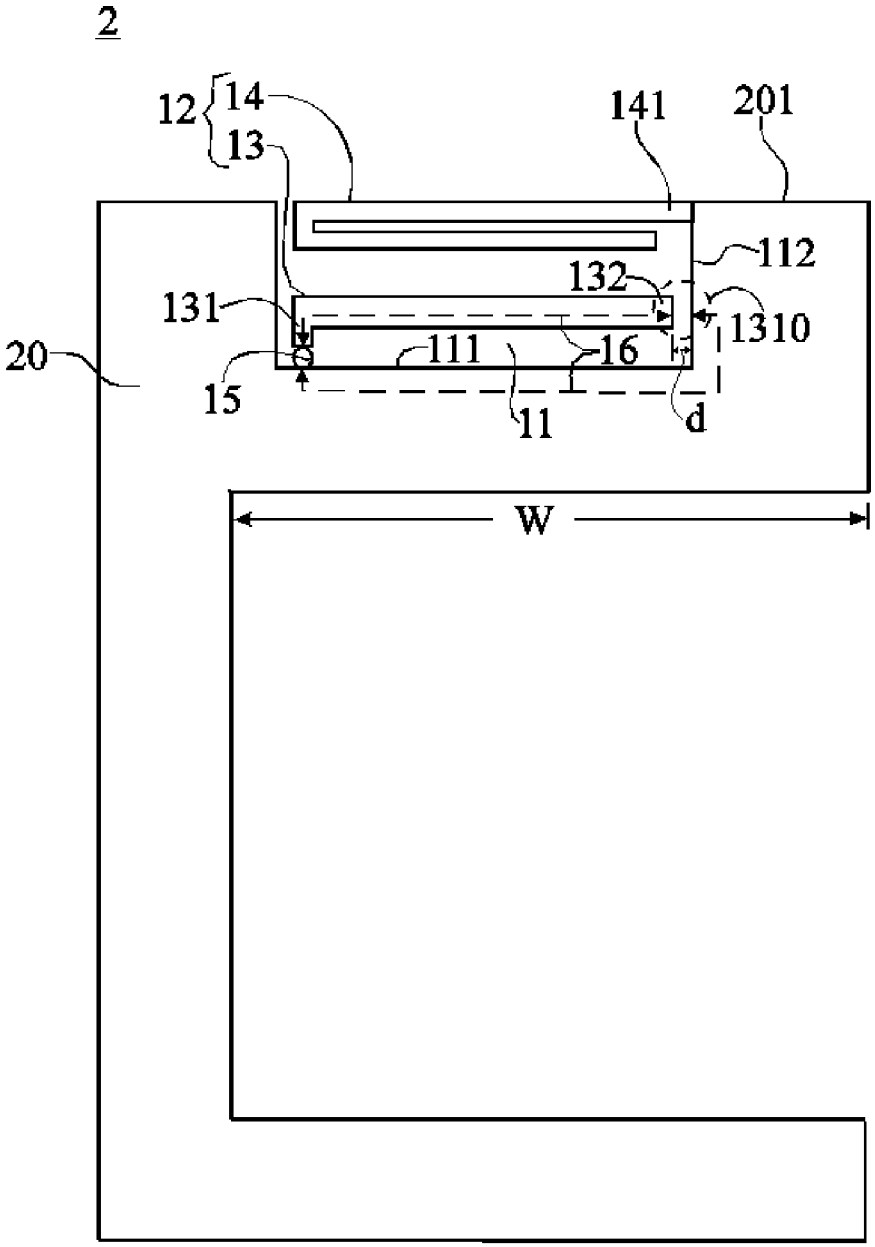
FIG. 2A is a schematic diagram of a communication device 2 according to one embodiment.
Figure 2B:
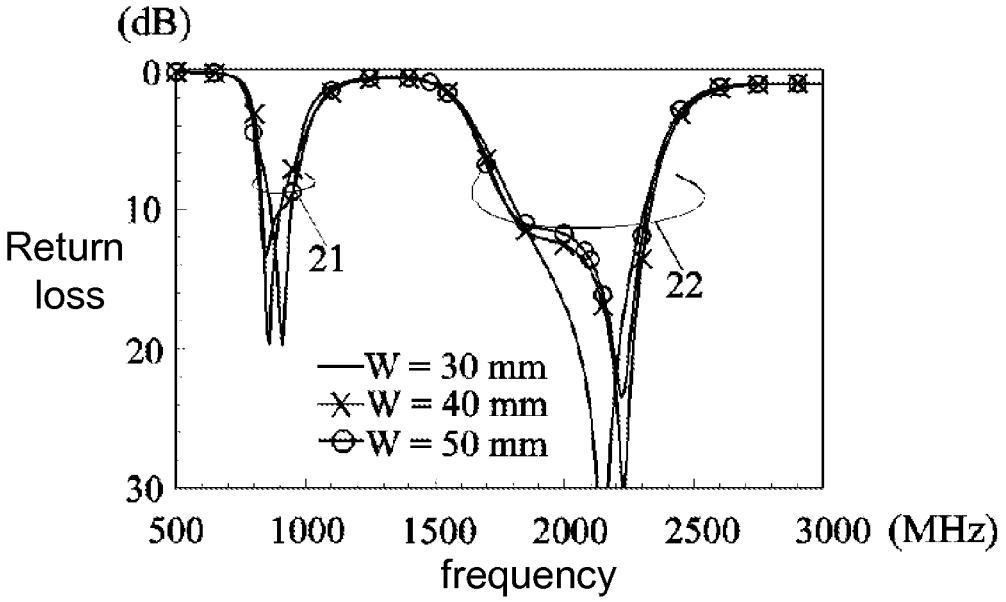
FIG. 2B is a diagram showing return loss of an antenna element of the communication device 2 corresponding to different structural parameters W of a ground plane according to one embodiment.

FIG. 2A shows a schematic diagram of a communication device 2 according to one embodiment. In FIG. 2A, the antenna element 12 in FIG. 1A is disposed at a ground plane 20 having a variable structural parameter W. FIG. 2B shows a diagram comparing return losses obtained after optimizing the size of the antenna element 12 of the communication device 2 in FIG. 2A under different structural parameters W. As seen from FIG. 2A, after optimizing the size of the antenna element 12 under different structural changes (W=30, 40, 50 mm) of the ground plane 20, good impedance bandwidth may be achieved for both the first operating frequency band 21 and the second operating frequency band 22. This is mainly because the equivalent loop resonant structure 16 could make more strong surface currents excited by the antenna element 12 to be concentrated at the area of ground plane 20 around the antenna element 12 when the antenna element 12 resonates. Thus, when implementing the embodiment to an actual product, undesirable effects caused by different shapes of the ground plane on the resonant mode excited by the antenna element 12 may be decreased. It should be noted that, details of the effects caused by different shapes of the ground plane 20 on the resonant mode excited by the antenna element 12 are an exemplary demonstration rather than limitations to the embodiments. The ground plane 20 may also have other irregular changes, and the antenna element 12 of the communication device of the embodiments may also achieve similar effects as those in FIG. 2B.

Figure 3:
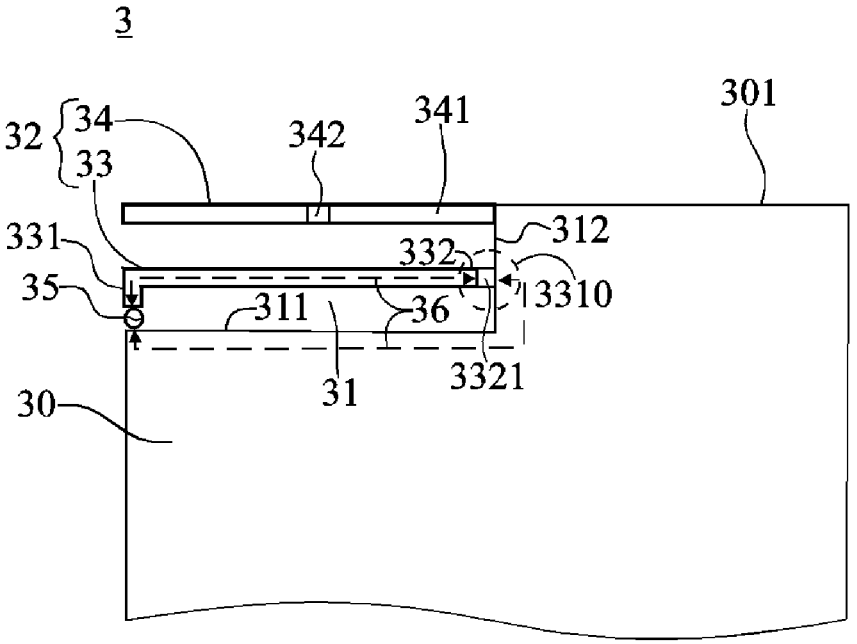
FIG. 3 is a schematic diagram of a communication device 3 according to one embodiment.

FIG. 3 shows a schematic diagram of a communication device 3 according to one embodiment. As shown in FIG. 3, the communication device 3 comprises a ground plane 30 and an antenna element 32. An edge 301 (an upper edge in FIG. 3) of the ground plane 30 is embedded with a notch 31. The notch 31 of the ground plane 30 has at least a first edge 311 and a second edge 312. The antenna element 32, located at the notch 31, has at least a first operating frequency band and a second operating frequency band higher than the first operating frequency band. The antenna element 32 includes a first conductive portion 33 and a second conductive portion 34. The first conductive portion 33 has a starting terminal 331 as a feeding terminal of the antenna element 32. The feeding terminal is electrically coupled to the first edge 311 of the notch 31 via a signal source 35. The first conductive portion 33 substantially extends along the first edge 311, and further has an end terminal 332. A capacitive coupling portion 3310 is formed between the end terminal 332 of the first conductive portion 33 and the ground plane 30. The capacitive coupling portion 3310 comprises a capacitive element 3321 electrically coupled between the end terminal 332 and the ground plane 30. The second conductive portion 34 has a shorting terminal 341 electrically coupled or connected to the second edge 312 of the notch 31. The second conductive portion 34 further comprises an inductive element 342 for simplifying a structural complexity of the second conductive portion 34 as well as shortening the length of the second conductive portion 34. A matching circuit may be provided between the feeding terminal of the antenna element 32 and the signal source 35 to adjust an impedance bandwidth of the operating frequency bands of the antenna element 32. The matching circuit may comprise a capacitive, inductive, or resistive element or a signal transmission line or any combination thereof. A matching circuit may also be provided between the shorting terminal 341 of the second conductive portion 34 and the ground plane 30 to further adjust the impedance bandwidth of the operating frequency bands of the antenna element 32. The matching circuit may comprise a capacitive, inductive, or resistive element or a signal transmission line or any combination thereof.

In the communication device 3 in FIG. 3, the notch 31 may substantially be a rectangle. The first edge 311 is connected with the second edge 312 and has a length greater than a length of the second edge 312. The shorting terminal 341 of the second conductive portion 34 and the feeding terminal 331 of the antenna element 32 are respectively located near two end points of a diagonal line of the notch 31. The capacitive coupling portion 3310 comprises a capacitive element 3321 electrically coupled between the end terminal 332 and the ground plane 30. By adjusting a capacitance value of the capacitive element 3321, an equivalent loop resonant structure 36 is formed by the first conductive portion 33 and the first edge 311 of the ground plane 30. The equivalent loop resonant structure 36, forming an excitation source of the second conductive portion 34, excites the second conductive portion 34 to resonate for generating the first and second operating frequency bands of the antenna element 32. The second operating frequency band is formed by a higher resonant mode of the first operating frequency band. The first and second operating frequency bands respectively cover at least one communication system band, and are for transceiving electromagnetic signals.

In the communication device 3 in FIG. 3, the equivalent loop resonant structure 36 formed by the first conductive portion 33 and the first edge 311 could make more strong surface currents excited by the antenna element 32 to be concentrated at the area of the ground plane 30 around the antenna element 32 when the antenna element 32 resonates. Thus, the variation degree of input impedance at the feeding terminal (the starting terminal 331) of the antenna element 32 could be mitigated to increase the operating bandwidth of the resonant modes of the antenna element 32. Further, when the antenna element 32 is at resonance, the equivalent loop resonant structure 36 could make more strong surface currents excited by the antenna element 32 to be concentrated at the area of the ground plane 30 around the antenna element 32. Thus, when implementing the embodiment to an actual product, undesirable effects caused by different shapes of the ground plane 30 on the resonant modes excited by the antenna element 32 could be lowered. By respectively disposing the shorting terminal 341 of the second conductive portion 34 and the feeding terminal 331 of the antenna element 32 near the two end points of the diagonal line of the notch 31, the excitation source formed by the equivalent loop resonant structure 36 is allowed to utilize the first edge 311 and the second edge 312 as a part of current resonant paths of the antenna element 32. Hence, the required resonant length of the second conductive portion 34 could be decreased to reduce an overall size of the antenna element 32. The length of the second conductive portion 34 is smaller than one-fifth wavelength of the lowest operating frequency in the lowest communication system band covered by the first operating frequency band 31. By designing the equivalent loop resonant structure 36, the second conductive portion 34 is excited to resonate for generating the lower and higher resonant modes. Thus, in addition to achieving multiband operations, the overall size of the antenna element 32 could also be reduced, compared to conventional dual-path antenna designs of mobile phones. Furthermore, by designing the second conductive portion 34 to be electrically coupled to the second edge 312, the distance between the second conductive portion 34 and the first edge 311 is also increased for reducing mutual coupling between the second conductive portion 34 and the ground plane 30, so as to enhance radiation efficiencies of the first and second operating frequency bands generated by the resonance of the second conductive portion 34. The first conductive portion 33 or the second conductive portion 34 may also be designed as having a meandering section for reducing the size of the antenna element 32.

In the communication device 3 in FIG. 3, the notch 31 is substantially a rectangle, and the first conductive portion 33 is substantially an inverted L-shaped structure. It should be noted that, details of FIG. 3 are illustrated as a design example of the communication device 3 and are not to be construed as limitations to the embodiments. The first conductive portion 33 and the second conductive portion 34 may be structures in other forms having different bending designs, or may be non-planar stereoscopic structures. The notch 31 may also be a non-rectangle or a shape having irregular edges, and may also achieve the same effects as the communication device 1 in FIG. 1A.

Figure 4:
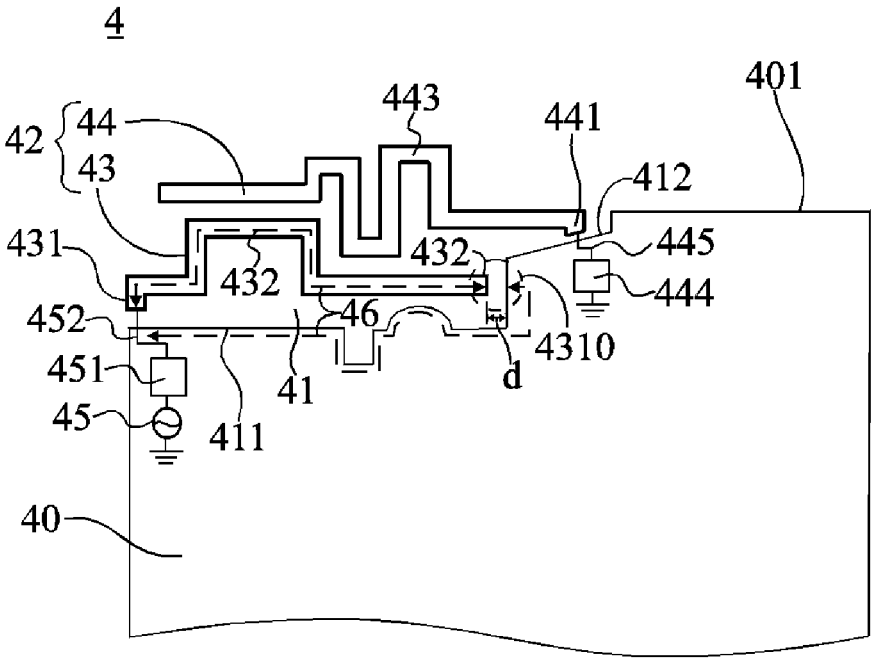
FIG. 4 is a schematic diagram of a communication device 4 according to one embodiment.

FIG. 4 shows a schematic diagram of a communication device 4 according to one embodiment. As shown in FIG. 4, the communication device 4 comprises a ground plane 40 and an antenna element 42. An edge 401 (an upper edge in FIG. 4) of the ground plane 40 is embedded with a notch 41. The notch 41 of the ground plane 40 has at least a first edge 411 and a second edge 412. The antenna element 42, located at the notch 41, has at least a first operating frequency band and a second operating frequency band, with the first operating frequency band being lower than the second operating frequency band. The antenna element 42 comprises a first conductive portion 43 and a second conductive portion 44. The first conductive portion 43 has a starting terminal 431 as a feeding terminal of the antenna element 42. The feeding terminal is electrically coupled to the first edge 411 of the notch 41 via a signal source 45. The first conductive portion 43 substantially extends along the first edge 411, and further has an end terminal 432. A capacitive coupling portion 4310 is formed between the end terminal 432 of the first conductive portion 43 and the ground plane 40. The second conductive portion 44 has a shorting terminal 441 electrically coupled or connected to the second edge 412 of the notch 41. A matching circuit 451 is provided between the feeding terminal of the antenna element 42 and the signal source 45 to adjust an impedance bandwidth of the operating frequency bands of the antenna element 42. The matching circuit 451 may comprise a capacitive, inductive, or resistive element or a signal transmission line or any combination thereof. A matching circuit 444 is provided between the shorting terminal 441 of the second conductive portion 44 and the ground plane 40 to adjust the impedance bandwidth of the operating frequency bands of the antenna element 42. The matching circuit 444 may comprise a capacitive, inductive, or resistive element or a signal transmission line or any combination thereof. The second conductive portion 44 may also be designed as having a meandering section for reducing the overall size of the second conductive portion 44.

In the communication device 4 in FIG. 4, the first edge 411 and the second edge 412 of the notch 41 are irregularly shaped. The first edge 411 is connected with the second edge 412, and has a length greater than a length of the second edge 412. The capacitive coupling portion 4310 has a coupling distance d. By adjusting the coupling distance d, an equivalent loop resonant structure 46 is formed by the first conductive portion 43 and the first edge 411 of the ground plane 40. The equivalent loop resonant structure 46, forming an excitation source for the second conductive portion 44, excites the second conductive portion 44 to resonate for generating the first and second operating frequency bands of the antenna element 42. The second operating frequency band is formed by the higher resonant mode of the first operating frequency band. The first and second operating frequency bands respectively cover at least one communication system band, and are for transceiving electromagnetic signals. The coupling distance d is less than or equal to two percent of the wavelength of the lowest operating frequency of the lowest communication system band covered by the first operating frequency band. The capacitive coupling portion 4310 may also be designed with a capacitive element. By adjusting a capacitance value of the capacitive element, the equivalent loop resonant structure 46 may also be formed by the first conductive portion 43 and the first edge 411 of the ground plane 40.

In the communication device 4 in FIG. 4, the equivalent loop resonant structure 46 formed by the first conductive portion 43 and the first edge 411 makes stronger and more uniform surface current to be excited at the area of ground plane 40 around the antenna element 42. Thus, the variation degree of input impedance at the feeding terminal (the starting terminal 431) of the antenna element 42 is mitigated to increase the operating bandwidth of the resonant modes of the antenna element 42. Further, when the antenna element 42 is at resonance, the equivalent loop resonant structure 46 could make more strong surface currents excited by the antenna element 42 to be concentrated at the area of the ground plane 40 around the antenna element 42. Thus, when implementing the embodiment to an actual product, undesirable effects caused by different shapes of the ground plane 40 on the resonant modes excited by the antenna element 42 are decreased. With the excitation source formed by the equivalent loop resonant structure 46, the first edge 411 and the second edge 412 are utilized as a part of current resonant paths of the antenna element 42. Hence, the required resonant length of the second conductive portion 44 is decreased to reduce an overall size of the antenna element 42. The length of the second conductive portion 44 is smaller than one-fifth wavelength of the lowest operating frequency in the lowest communication system band covered by the first operating frequency band. By designing the equivalent loop resonant structure 46 to excite the second conductive portion 44 for generating the lower and higher resonant modes, not only multi-band operations for the antenna element 42 is achieved, but also the overall size of the antenna element 42 is reduced, compared to conventional dual-path antenna designs of mobile phones. Furthermore, by designing the second conductive portion 44 to be electrically coupled to the second edge 412, the distance between the second conductive portion 44 and the first edge 411 is also increased for reducing mutual coupling between the second conductive portion 44 and the ground plane 40, so as to enhance radiation efficiencies of the first and second operating frequency bands generated by the resonance of the second conductive portion 44. The first conductive portion 43 or the second conductive portion 44 may also be designed as having an inductive element or a meandered section for reducing the size of the antenna element 42. It should be noted that, details of FIG. 4 are illustrated as a design example of the communication device 4 and are not to be construed as limitations to the embodiments. The first conductive portion 43 and the second conductive portion 44 may be structures in other forms having different bending designs, or may be non-planar stereoscopic structures. The notch 41 may also be a shape having irregular edges, and may also achieve the same effects as the communication device 1 in FIG. 1A.

Figure 5:
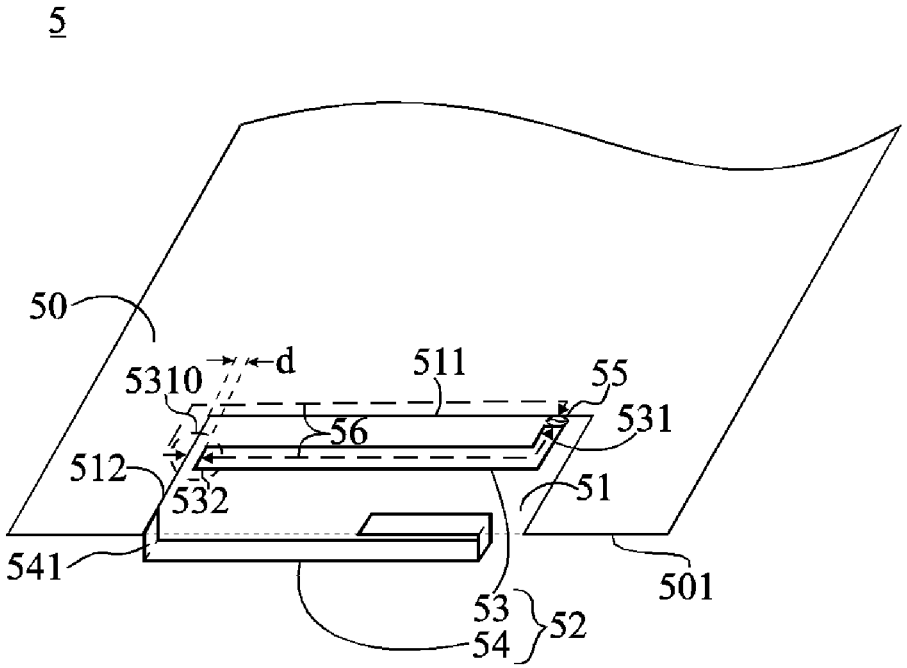
FIG. 5 is a schematic diagram of a communication device 5 according to one embodiment.

FIG. 5 shows a communication device 5 according to one embodiment. As shown in FIG. 5, the communication device 5 comprises a ground plane 50 and an antenna element 52. An edge 501 of the ground plane 50 is embedded with a notch 51. The notch 51 of the ground plane 50 has at least a first edge 511 and a second edge 512. The antenna element 52, located at the notch 51, has at least a first operating frequency band and a second operating frequency band higher than the first operating frequency band. The antenna element 52 comprises a first conductive portion 53 and a second conductive portion 54. The first conductive portion 53 has a starting terminal 531 as a feeding terminal of the antenna element 52. The feeding terminal is electrically coupled to the first edge 511 of the notch 51 via a signal source 55. The first conductive portion 53 substantially extends along the first edge 511, and further has an end terminal 532. A capacitive coupling portion 5310 is formed between the end terminal 532 of the first conductive portion 53 and the ground plane 50. The second conductive portion 54 has a shorting terminal 541 electrically coupled or connected to the second edge 512 of the notch 51. A matching circuit may be provided between the feeding terminal of the antenna element 52 and the signal source 55 to adjust an impedance bandwidth of the operating frequency bands of the antenna element 52. The matching circuit may comprise a capacitive, inductive, or resistive element or a signal transmission line or any combination thereof. A matching circuit may be further provided between the shorting terminal 541 of the second conductive portion 54 and the ground plane 50 to adjust an impedance bandwidth of the operating frequency bands of the antenna element 52. The matching circuit may comprise a capacitive, inductive, or resistive element or a signal transmission line or any combination thereof.

In the communication device 5 in FIG. 5, the notch 51 is substantially a rectangle. The first edge 511 is connected with the second edge 512, and has a length greater than a length of the second edge 512. The shorting terminal 541 of the second conductive portion 54 and the feeding terminal 531 of the antenna element 52 are respectively near two end points of a diagonal line 513 of the notch 51. The second conductive portion 54 is a non-planar stereoscopic structure. The capacitive coupling portion 5310 has a coupling distance d. By adjusting the coupling distance d, an equivalent loop resonant structure 56 is formed by the first conductive portion 53 and the first edge 511 of the ground plane 50. The equivalent loop resonant structure 56, forming an excitation source of the second conductive portion 54, excites the second conductive portion 54 to resonate for generating the first and second operating frequency bands of the antenna element 52. The second operating frequency band has higher frequencies than the first operating frequency band. The first and second operating frequency bands respectively cover at least one communication system band, and are for transceiving electromagnetic signals. The coupling distance d is less than or equal to two percent of the wavelength of the lowest operating frequency of the lowest communication system band covered by the first operating frequency band. The capacitive coupling portion 5310 may also be designed has having a capacitive element. By adjusting a capacitance value of the capacitive element, the equivalent loop resonant structure 56 could also be formed by the first conductive portion 53 and the first edge 511 of the ground plane 50.

In the communication device 5 in FIG. 5, the equivalent loop resonant structure 56 formed by the first conductive portion 53 and the first edge 511 would make stronger and more uniform surface current to be excited at the area of ground plane 50 around the antenna element 52. Thus, variation degrees of input impedance at the feeding terminal (the starting terminal 531) of the antenna element 52 could be mitigated to increase the operating bandwidth of the resonant modes of the antenna element 52. Further, when the antenna element 52 is at resonance, the equivalent loop resonant structure 56 can lead to more strong surface currents excited by the antenna element 52 to be concentrated at the area of ground plane 10 around the antenna element 52. Thus, when implementing the embodiment to an actual product, undesirable effects caused by different shapes of the ground plane 50 on the resonant modes excited by the antenna element 52 are reduced. Further, by respectively disposing the shorting terminal 541 of the second conductive portion 54 and the feeding terminal 531 of the antenna element 531 near the two end points of the diagonal line 513 of the notch 51, the excitation source formed by the equivalent loop resonant structure 56 is allowed to utilize the first edge 511 and the second edge 512 as a part of current resonant paths of the antenna element 52. Hence, the required resonant length of the second conductive portion 54 is decreased to reduce an overall size of the antenna element 52. The length of the second conductive portion 54 is smaller than one-fifth wavelength of the lowest operating frequency in the lowest communication system band covered by the first operating frequency band. By designing the equivalent loop resonant structure 56 to excite the second conductive portion 54 for generating the lower and higher resonant modes, not only multi-band operations for the antenna element 52 is achieved, but also the overall size of the antenna element 52 is reduced, compared to a conventional dual-path antenna designs of mobile phones. Furthermore, by designing the second conductive portion 54 to be electrically coupled to the second edge 512, the distance between the second conductive portion 54 and the first edge 511 is also increased for reducing mutual coupling between the second conductive portion 54 and the ground plane 50, so as to further enhance radiation efficiencies of the first and second operating frequency bands generated by the resonance of the second conductive portion 54. The first conductive portion 53 or the second conductive portion 54 may also be designed with an inductive element or a meandering section for further reducing the size of the antenna element 52. In the communication device 5 in FIG. 5, the notch 51 is substantially a rectangle, the first conductive portion 53 is substantially an inverted L-shaped structure, and the second conductive portion 54 has multiple bending sections and is a non-planar stereoscopic structure. It should be noted that, details of FIG. 5 are illustrated as a design example of the communication device 5 and are not to be construed as limitations to the embodiments. The first conductive portion 53 and the second conductive portion 54 may be structures in other forms having different bending designs, or may be non-planar stereoscopic structures. The notch 51 may also be a non-rectangle or a shape having irregular edges, and can also achieve the same effects as the communication device 1 in FIG. 1A.

Figure 6:
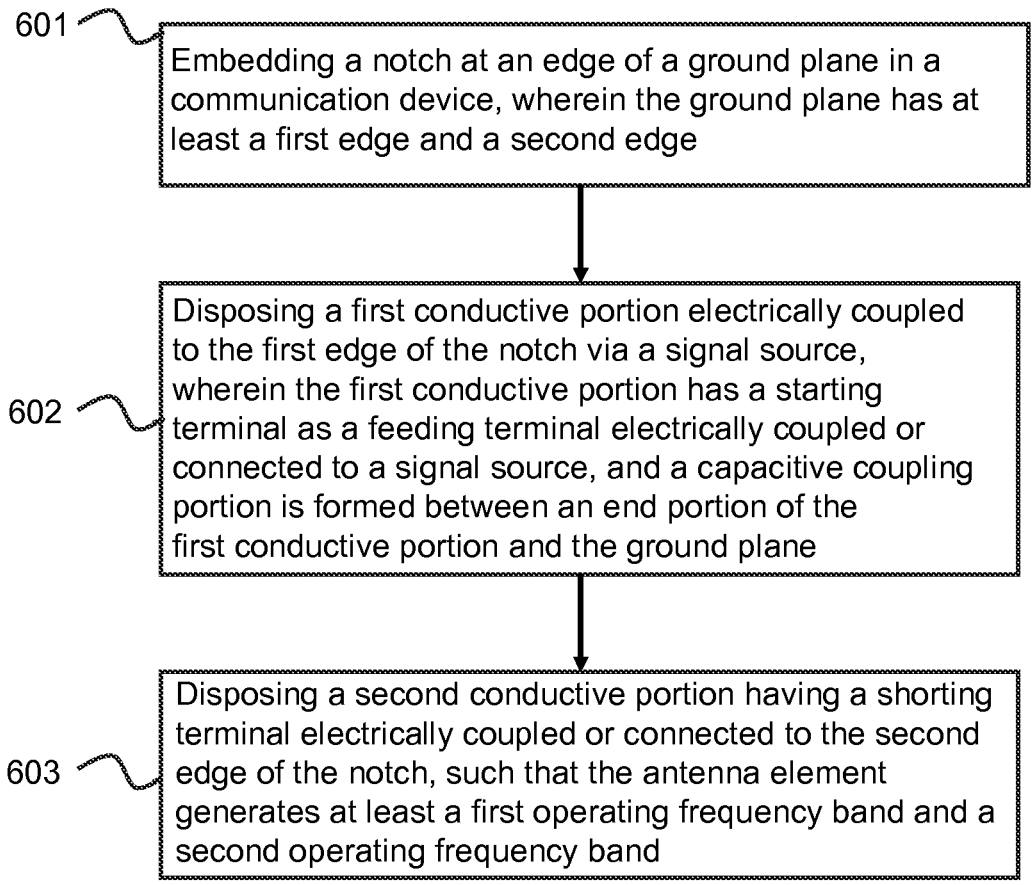
FIG. 6 is flowchart of a method for designing an antenna of a communication device according to one embodiment.

FIG. 6 shows a flowchart of a method for designing an antenna element of a communication device according to one embodiment. In step 601, a notch is embedded at an edge of a ground plane in the communication device. The notch of the ground plane has at least a first edge and a second edge. In step 602, a first conductive portion electrically coupled to the first edge of the notch via a signal source is disposed. The first conductive portion has a starting terminal, electrically coupled to the first edge of the notch via a signal source, as a feeding terminal of the antenna element. A capacitive coupling portion is formed between an end terminal of the first conductive portion and the ground plane. In step 603, a second conductive portion having a shorting terminal electrically coupled or connected to the second edge of the notch is disposed, such that the antenna element generates at least a first operating frequency band and a second operating frequency band. The first operating frequency band is lower than the second operating frequency band.

In the method for designing an antenna element in FIG. 6 according to one embodiment, the first conductive portion substantially extends along the first edge. The capacitive coupling portion has a coupling distance. By adjusting the coupling distance, an equivalent loop resonant structure is formed by the first conductive portion and the first edge of the notch. The equivalent loop resonant structure, forming an excitation source of the second conductive portion, excites the second conductive portion to form resonance for generating the first and second operating frequency bands of the antenna element. The second operating frequency band is formed by higher resonant modes of the first operating frequency band. The first and second operating frequency bands respectively cover at least one communication system band, and are for transceiving electromagnetic signals. The coupling distance is less than or equal to two percent of the wavelength of the lowest operating frequency of the lowest communication system band covered by the first operating frequency band. The capacitive coupling portion may also be designed with a capacitive element. By adjusting a capacitance value of the capacitive element, the equivalent loop resonant structure may also be formed by the first conductive portion and the first edge of the notch.

In the method for designing an antenna element in FIG. 6 according to one embodiment, the equivalent loop resonant structure formed by the first conductive portion and the first edge makes stronger and more uniform surface current to be excited at the area of the ground plane. Thus, variation degrees of input impedance at the feeding terminal of the antenna element are mitigated to increase the operating bandwidth of the resonant modes of the antenna element. Further, when the antenna element is at resonance, the equivalent loop resonant structure can make more strong surface currents excited by the antenna element to be concentrated at the area of the ground plane around the antenna element. Thus, when implementing the embodiment to an actual product, undesirable effects caused by different shapes of the ground plane on the resonant modes excited by the antenna element are decreased. Further, with the excitation source formed by the equivalent loop resonant structure, the first edge and the second edge are utilized as a part of current resonant paths of the antenna element. Hence, the required resonant length of the second conductive portion is decreased to reduce an overall size of the antenna element. The length of the second conductive portion is smaller than one-fifth of the wavelength of the lowest operating frequency in the lowest communication system band covered by the first operating frequency band. By designing the equivalent loop resonant structure to excite the second conductive portion for generating the lower and higher resonant modes, not only multi-band operations for the antenna element is achieved, but also the overall size of the antenna element is reduced, compared to a conventional dual-path antenna designs of a mobile phones. Furthermore, by designing the second conductive portion to be electrically coupled to the second edge, the distance between the second conductive portion and the first edge is also increased for reducing mutual coupling between the second conductive portion and the ground plane, so as to further increase radiation efficiencies of the first and second operating frequency bands generated by the resonance of the second conductive portion.

In the method for designing an antenna element in FIG. 6 according to one embodiment, the first conductive portion or the second conductive portion may be integrated with an inductive element or a meandering section, or any combination thereof for reducing the size of the antenna element. A matching circuit may be provided between the feeding terminal of the antenna element and the signal source to adjust an impedance bandwidth of the operating frequency bands of the antenna element. The matching circuit may comprise a capacitive, inductive, or resistive element or a signal transmission line, or any combination thereof. A matching circuit may also be provided between the shorting terminal of the second conductive portion and the ground plane to further adjust the impedance bandwidth of the operating frequency bands of the antenna element. The matching circuit may comprise a capacitive, inductive, or resistive element or a signal transmission line, or any combination thereof. The first conductive portion and the second conductive portion may have different bending designs, or may be non-planar stereoscopic structures. The notch may also be a non-rectangle or a shape having irregular edges, and can also achieve the same or similar effects as the communication device 1 in FIG. 1A.

Figure 7:
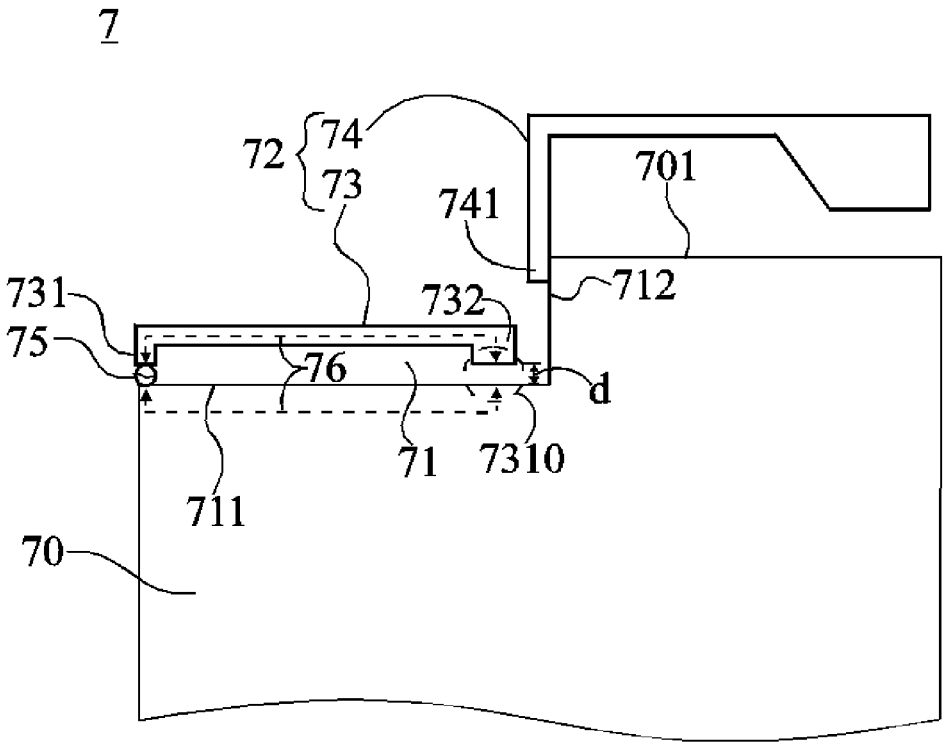
FIG. 7 is a schematic diagram of a communication device 7 according to one embodiment.

The method for design an antenna element in FIG. 6 is applicable to a communication device 7 in FIG. 7. FIG. 7 shows a schematic diagram of the communication device 7 according to one embodiment. The method for designing an antenna 72 comprises the following steps. A notch 71 is embedded at an edge 701 of a ground plane 70 in the communication device 7. The ground plane 70 has at least a first edge 711 and a second edge 712. A first conductive portion 73 electrically coupled to the first edge 711 of the notch 71 via a signal source 75 is disposed. The first conductive portion 73 has a starting terminal 731, electrically coupled to the first edge 711 of the notch 71 via the signal source 75, as a feeding terminal of the antenna element 72. A capacitive coupling portion 7310 is formed between an end terminal 732 of the first conductive portion 73 and the ground plane 70. A second conductive portion 74 having a shorting terminal 741 electrically coupled or connected to the second edge 712 of the notch 71 is disposed, such that the antenna element 72 generates at least a first operating frequency band and a second operating frequency band. The first operating frequency band is lower than the second operating frequency band.

In the communication device 7 in FIG. 7, the first conductive portion 73 substantially extends along the first edge 711. The capacitive coupling portion 7310 has a coupling distance d. By adjusting the coupling distance d, an equivalent loop resonant structure 76 is formed by the first conductive portion 73 and the first edge 711 of the notch 71. The equivalent loop resonant structure 76, forming an excitation source of the second conductive portion 74, excites the second conductive portion 74 to form resonance for generating the first and second operating frequency bands of the antenna element 72. The second operating frequency band is formed by higher resonant modes of the first operating frequency band. The first and second operating frequency bands respectively cover at least one communication system band, and are for transceiving electromagnetic signals. The coupling distance d is less than or equal to two percent of the wavelength of a lowest operating frequency in a lowest communication system band covered by the first operating frequency band. The capacitive coupling portion 7310 may also be designed as having a capacitive element. By adjusting a capacitance value of the capacitive element, the equivalent loop resonant structure 76 may also be formed by the first conductive portion 73 and the first edge 711 of the notch 71.

In the communication device 7 in FIG. 7, the equivalent loop resonant structure 76 formed by the first conductive portion 73 and the first edge 711 makes stronger and more uniform surface current to be excited at the area of the ground plane 70 around the antenna element 72. Thus, variation degrees of input impedance at the feeding terminal of the antenna element 72 are mitigated to increase the operating bandwidth of the resonant modes of the antenna element 72. Further, when the antenna element 72 is at resonance, the equivalent loop resonant structure 76 could make more strong surface currents excited by the antenna element 72 to be concentrated at the area of the ground plane 70 around the antenna element 72. Thus, when implementing the embodiment to an actual product, undesirable effects caused by different shapes of the ground plane 70 on the resonant modes excited by the antenna element 72 are mitigated. Further, with the excitation source formed by the equivalent loop resonant structure 76, the first edge 711 and the second edge 712 are as a part of current resonant paths of the antenna element 72. Hence, the required resonant length of the second conductive portion 74 is decreased to reduce an overall size of the antenna element 72. The length of the second conductive portion 74 is smaller than one-fifth of the wavelength of the lowest operating frequency in the lowest communication system frequency band covered by the first operating frequency band. By designing the equivalent loop resonant structure 76, the second conductive portion 74 is excited to form resonance for generating lower and higher resonant modes. Thus, in addition to achieving multiband operations, the size of the antenna can also be reduced, compared to conventional dual-path antenna designs of mobile phones. Furthermore, by designing the second conductive portion 74 to be electrically coupled to the second edge 712 of the notch 71, the distance between the second conductive portion 74 and the first edge 711 is also increased for reducing mutual coupling between the second conductive portion 74 and the ground plane 70, so as to enhance radiation efficiencies of the first and second operating frequency bands generated by the resonance of the second conductive portion 74.

In the communication device 7 in FIG. 7, the first conductive portion 73 or the second conductive portion 74 may comprise an inductive element or a meandering section for reducing the overall size of the antenna element 72. A matching circuit may be provided between the feeding terminal 731 of the antenna element 72 and the signal source 75 to adjust an impedance bandwidth of the operating frequency bands of the antenna element 72. The matching circuit may comprise a capacitive, inductive, or resistive element or a signal transmission line. A matching circuit may also be provided between the shorting terminal 741 of the second conductive portion 74 and the ground plane 70 to adjust the impedance bandwidth of the operating frequency bands of the antenna element 72. The matching circuit may comprise a capacitive, inductive, or resistive element or a signal transmission line, or any combination thereof. The first conductive portion 73 and the second conductive portion 74 may have different bending designs, or may be non-planar stereoscopic structures. The notch 71 may also be a non-rectangle or a shape having irregular edges, and may also achieve the same effects as the communication device 1 in FIG. 1A.

With the above embodiments, it is demonstrated that the communication device and the method for designing an antenna element thereof described may overcome an unfavorable issues or effects caused by incomplete system ground planes of a mobile communication device on the mode excitation of lower frequency bands of an antenna. In the communication device and the method for designing an antenna element thereof according to the embodiments, a structurally optimized antenna element is not only applicable to different sizes of system ground planes to excite multi-band resonant modes with good impedance matching, but also capable of reducing the overall size of the antenna element.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A communication device, comprising:

a ground plane, embedded with a notch at an edge thereof, having at least a first edge and a second edge at the notch; and an antenna element, disposed at the notch, having at least a first operating frequency band and a second operating frequency band higher than the first operating frequency band, the antenna element comprising:

a first conductive portion, having a starting terminal as a feeding terminal of the antenna element, wherein the feeding terminal is electrically coupled to the first edge of the notch via a signal source, and a capacitive coupling portion is formed between an end terminal of the first conductive portion and the second edge of the ground plane; and a second conductive portion, having a shorting terminal, electrically coupled or connected to the second edge of the notch, wherein the first and second edges of the notch are located on different sides and the first edge has a length greater than a length of the second edge, wherein the shorting terminal and the feeding terminal are respectively located near two end points of a diagonal line of the notch, and the first conductive portion extends along the first edge to the second edge, and the capacitive coupling portion makes the first conductive portion and the first edge of the ground plane forming an equivalent loop resonant structure, wherein the equivalent loop resonant structure forms an excitation source of the second conductive portion, and the excitation source excites the second conductive portion for resonance to generate the first and second operating frequency bands of the antenna element, and the excitation source formed by the equivalent loop resonant structure utilizes the first edge, the second edge or another edge of the notch as a part of current resonant paths of the second conductive portion, wherein the second conductive portion has a length smaller than one-fifth wavelength of a lowest operating frequency of a lowest communication system band covered by the first operating frequency band.

2. The communication device according to claim 1, wherein the first and second operating frequency bands respectively cover at least one communication system band, and are for transceiving electromagnetic signals.

3. The communication device according to claim 1, wherein the capacitive coupling portion has a coupling distance less than or equal to two percent of a wavelength of a lowest operating frequency of a lowest communication system band covered by the first operating frequency band.

4. The communication device according to claim 1, wherein a matching circuit is provided between the shorting terminal of the second conductive portion and the ground plane.

5. The communication device according to claim 1, wherein the capacitive coupling portion comprises a capacitive element.

6. The communication device according to claim 1, wherein a matching circuit is provided between the starting terminal of the first conductive portion and the signal source.

7. The communication device according to claim 1, wherein the first or second conductive portion comprises an inductive element and/or a meandering section, or any combination thereof.

8. A method for designing an antenna for a communication device, comprising:

embedding a notch at an edge of a ground plane of the communication device, wherein the notch of the ground plane has at least a first edge and a second edge;

disposing a first conductive portion electrically coupled to the first edge of the notch via a signal source, wherein the first conductive portion has a starting terminal as a feeding terminal of the antenna element, the feeding terminal is electrically coupled or connected to the signal source, and a capacitive coupling portion is formed between an end terminal of the first conductive portion and the second edge of the ground plane; and disposing a second conductive portion having a shorting terminal electrically coupled or connected to the second edge of the notch, such that the antenna element generates at least a first operating frequency band and a second operating frequency band higher than the first operating frequency band, wherein the first and second edges of the notch are located on different sides and the first edge has a length greater than a length of the second edge, wherein the shorting terminal and the feeding terminal are respectively located near two end points of a diagonal line of the notch, and the first conductive portion extends along the first edge to the second edge, and the capacitive coupling portion makes the first conductive portion and the first edge of the ground plane forming an equivalent loop resonant structure, wherein the equivalent loop resonant structure forms an excitation source of the second conductive portion, and the excitation source excites the second conductive portion for resonance to generate the first and second operating frequency bands of the antenna element, and the excitation source formed by the equivalent loop resonant structure utilizes the first edge, the second edge or another edge of the notch as a part of current resonant paths of the second conductive portion, wherein the second conductive portion has a length smaller than one-fifth wavelength of a lowest operating frequency of a lowest communication system band covered by the first operating frequency band.

9. The method according to claim 8, wherein the first and second operating frequency bands respectively cover at least one communication system frequency band, and are for transceiving electromagnetic signals.

10. The method according to claim 8, wherein the capacitive coupling portion has a coupling distance less than or equal to two percent of the wavelength of a lowest operating frequency of a lowest communication system band covered by the first operating frequency band.

11. The method according to claim 8, further comprising:

providing a matching circuit between the shorting terminal of the second conductive portion and the ground plane.

12. The method according to claim 8, wherein the capacitive coupling portion comprises a capacitive element.

13. The method according to claim 8, further comprising:

providing a matching circuit between the starting terminal of the first conductive portion and the signal source.

14. The method according to claim 8, wherein the first or second conductive portion comprises an inductive element and/or a meandering section, or any combination thereof.

* * * * *